US006186068B1

(12) United States Patent
Gelbart

(10) Patent No.: US 6,186,068 B1
(45) Date of Patent: Feb. 13, 2001

(54) METHOD FOR HOLDING PRINTING SLEEVES IN AN IMAGING DEVICE

(75) Inventor: Daniel Gelbart, Vancouver (CA)

(73) Assignee: Creo SRL, Burnaby (CA)

( * ) Notice: Under 35 U.S.C. 154(b), the term of this patent shall be extended for 0 days.

(21) Appl. No.: 09/317,077

(22) Filed: May 18, 1999

(51) Int. Cl.[7] ..... B41L 3/02
(52) U.S. Cl. ..... 101/486; 101/401.1; 101/467
(58) Field of Search ..... 101/216, 454, 101/467, 465, 485, 486, 401.1

(56) References Cited

U.S. PATENT DOCUMENTS

| | | | | |
|---|---|---|---|---|
| 4,119,032 | | 10/1978 | Hollis | 101/216 |
| 4,697,516 | | 10/1987 | Rombout | 101/216 |
| 5,101,726 | | 4/1992 | Lübke et al. | 101/216 |
| 5,129,321 | * | 7/1992 | Fadner | 101/467 |
| 5,289,769 | | 3/1994 | Lewis | 101/218 |
| 5,440,987 | * | 8/1995 | Williams et al. | 101/454 |
| 5,760,880 | | 6/1998 | Fan et al. | 355/67 |

* cited by examiner

*Primary Examiner*—Ren Yan
(74) *Attorney, Agent, or Firm*—Oyen Wiggs Green & Mutala

(57) ABSTRACT

A method for imaging seamless printing sleeves of varying length and diameter includes providing a retractable support for the end of a mandrel holding the sleeve and a tilting mechanism to title the mandrel upwards, allowing sleeve replacement. Since different length sleeves can be used on a fixed length mandrel, a fixed size frame can be used for different sleeve lengths. Tilting of the mandrel allows the use of a rigid frame, eliminating the need for a removable end block.

16 Claims, 2 Drawing Sheets

METHOD FOR HOLDING PRINTING SLEEVES IN AN IMAGING DEVICE

FIELD OF THE INVENTION

The invention relates to printing and more particularly to digital imaging of seamless printing sleeves, a field also known as Computer-to-Plate imaging.

BACKGROUND OF THE INVENTION

In many types of printing, particularly flexographic printing, offset printing and screen printing, there is an advantage in using seamless sleeves as printing elements instead of plates wrapped around printing cylinders. Seamless sleeves allow printing of continuous patterns. The use of seamless sleeves allows printing presses to operate in a smoother manner. Before a sleeve can be mounted on a printing press it has to be imaged and processed, although some materials are available today which do not require processing. Prior art laser imaging devices for imaging such sleeves were built in the general form of a lathe. Such machines have: a mandrel on which a sleeve can be mounted, a fixed headstock for driving the sleeve, a moveable tailstock for supporting the sleeve, and a travelling laser imaging head. In these systems the travelling tailstock moves on tracks in order to accommodate sleeves of different lengths. Replacing a sleeve involves moving the tailstock away from the headstock, removing the mandrel from the exposure machine and removing the sleeve from the mandrel. Typically the sleeve is removed from the mandrel by connecting an air hose to the mandrel and pressurizing the inside, causing air to leak out from small holes under the sleeve. Such an air flow expands the sleeve and creates an air bearing, allowing the sleeve to slide off the mandrel and be replaced by a blank sleeve.

It is desired to simplify this multi-step process. There is a need for a simpler process that is more automated. Prior art more automated sleeve loading existed only on flexographic presses, however it was limited to a fixed size sleeve (unless press was re-configured for a different print format) and did not include some of the automatic steps of the present invention. In an exposure machine for sleeves it is desired to handle a large range of sleeve diameters and lengths without a large set-up process between sizes. The reason for that is that a single exposure machine typically has to serve a large number of presses, each of a different format. For this reason presses did not require easy changing of mandrels, just sleeves. It is also desired to allow the exposure machine to be built from a simple fixed length frame instead of an adjustable length. The present invention solves these problems and further improves the procedure of loading and unloading sleeves from an exposure device.

SUMMARY OF THE INVENTION

The invention uses a replaceable mandrel inside a fixed length frame. One end of the mandrel is driven, via a ball coupling, by the headstock. In this disclosure the terms "headstock" and "tailstock" have the same meaning as in machine-tools, where "headstock" is the driving end and "tailstock" is the support end. The tailstock is a fixed part of the frame and is not moveable, however the centre pin supporting the mandrel is retractable to allow the mandrel to swing away from the tailstock. The headstock is equipped with an actuator which is not contacting the mandrel while the latter is rotating but can engage the mandrel and swing it up in order to exchange sleeves. Air pressure is automatically connected to the inside of the mandrel to slide sleeves on and off. As the whole operation can be pneumatically or hydraulically activated, the machine operator only needs to slide the sleeves on and off. This allows a higher degree of automation and repeatability than prior art procedures. Details and further advantages of the invention will be apparent from studying the description of the preferred embodiment in conjunction with the drawings.

DESCRIPTION OF THE PREFERRED EMBODIMENT

Figure 1:
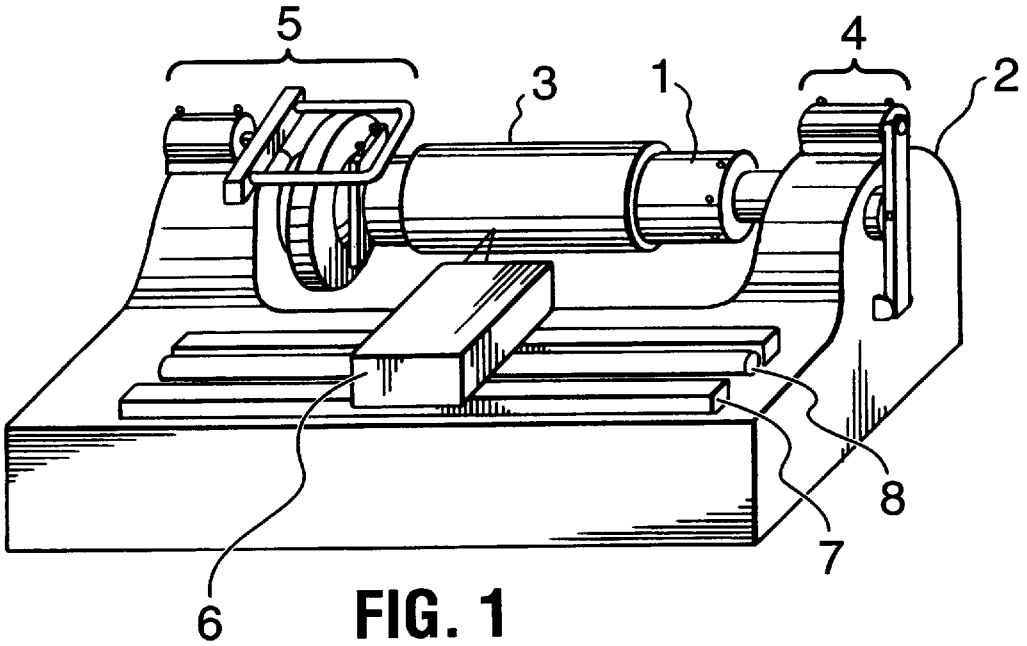
FIG. 1 is a general view of an exposure machine for printing sleeves according to the invention.
Figure 2:
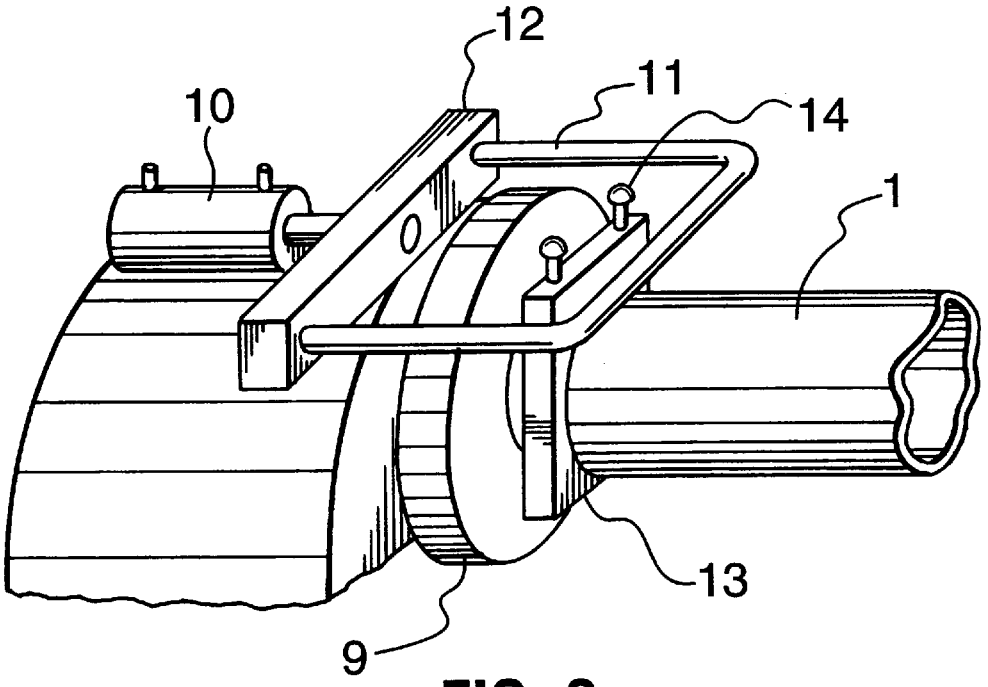
FIG. 2 is a close-up view of the headstock area of the exposure machine.

Referring now to FIG. 1 and 2, an exposure machine exposes printing sleeves 3 by using a laser head 6 travelling along the sleeve on tracks 7 under the control of lead screw 8. The data to be written on the sleeves is generated by a computer system generally known as a "Pre-Press System" and will not be discussed here. Sleeves 3 can be used for any type of printing, the main uses being flexographic, lithographic offset and screen printing (serigraphy). The invention is not limited to any particular type of printing. The sleeves may require further processing steps after being exposed by laser 6. Such further steps can be, but not limited to, UV exposure, thermal processing, chemical processing, physical processing, washing etc. The sleeves can also be of a processless type, in which laser 6 supplies all the energy needed to produce ready-to-print sleeves. By the way of example, laser 6 can ablate all the areas which should not print, leaving only the raised printing areas. This generates flexographic printing sleeves.

In the exposure machine, sleeves are held by interchangeable mandrel 1. Different mandrels are used for different sleeve diameters. Sometimes a packing sleeve, or "build up sleeve" as it is called, is used to match the outside diameter of the mandrel to the inside diameter of the sleeve. As the mandrel has to be easily changed it cannot be permanently attached to headstock 5. Since different length sleeves can be used on one length of mandrel, the frame 2 can be of a fixed length and tailstock 4 may be fixed (unlike prior art devices which use a moving tailstock similar to a lathe tailstock). In order to replace sleeve 3 mandrel 1 swings away from fixed tailstock 4. This is achieved by connecting mandrel 1 to headstock 5 using a ball joint, details of which are given later. An actuator 10, typically a pneumatic cylinder, is connected to yoke 11 via bar 12. In its normal position yoke 11 does not contact pins 14 on mandrel end-plate 13, allowing the mandrel to rotate freely. When pins 14 are aligned with yoke 11 and actuator 10 is retracted, yoke 11 engages pins 14 and swings mandrel 1 into the sleeve loading position.

Figure 3:
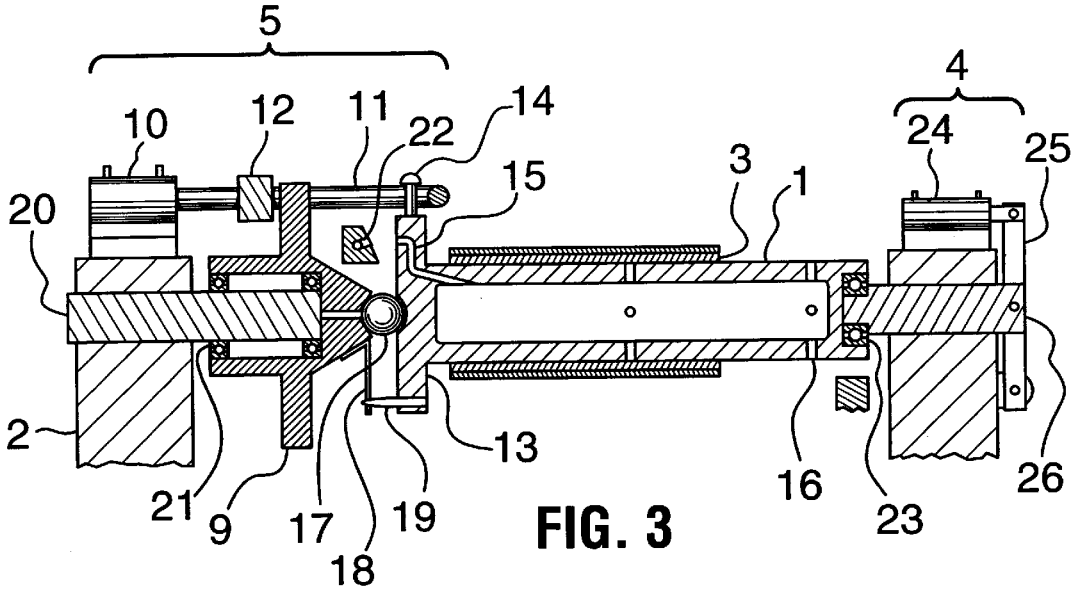
FIG. 3 is a longitudinal cross-section of an exposure machine according to the invention in the sleeve imaging position.
Figure 4:
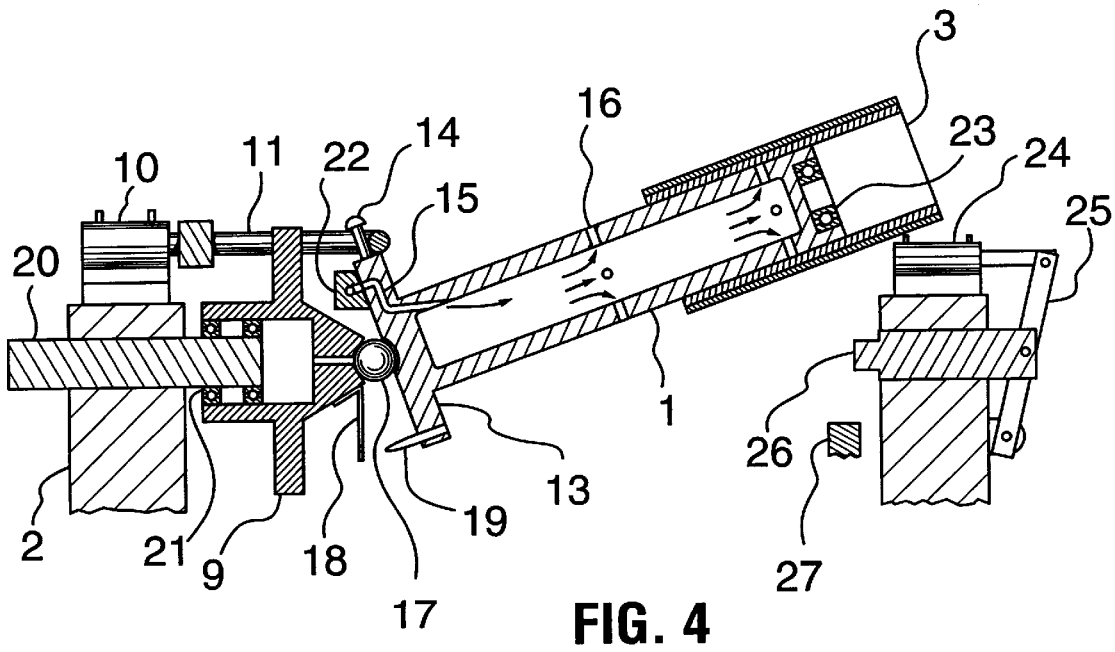
FIG. 4 is a longitudinal cross-section of an exposure machine according to the invention in the sleeve changing position.

Referring now to FIGS. 3 and 4, mandrel 1 is hollow and has air holes 16. When the hollow inside of mandrel is pressurized, via air passage 15, air escaping via holes 16 enlarges the diameter of sleeve 3 and allows it to slide freely. This method of sliding sleeves on and off mandrels is well known and is not part of the invention. The tailstock end of mandrel 1 is supported by pin 26 activated by actuator 24, typically pneumatic cylinder. Regulating air pressure in cylinder 24 also sets the axial load on bearings 23 and 21, providing the pre-load required for accurate running. Mandrel 1 is equipped with an end-plate 13 having an air passage 15, one or more pull-studs or pins 14 and driving pin 19. It is connected to headstock 5 via a ball 17 fitted into a suitable socket in drive unit 9. Drive unit 9 drives rotation of mandrel 1. Drive unit 9 is mounted on suitable bearings and is coupled to a motor (not shown). In this embodiment drive unit 9 consists of a large pulley allowed to rotate on stationary shaft 20 via bearings 21. Clearly any arrangement of shafts and bearings can be used here. For example, shaft 20 may be rotatably mounted to frame 2 by means of suitable bearings instead of being mounted in a fixed relation to frame 2. Drive unit 9 also contains a drive plate 18 used to couple the rotary motion to mandrel 1 via pin 19. It is desired to make drive plate 18 somewhat axially flexible in order to eliminate any backlash between drive unit 9 and mandrel 1.

Under normal operation the inside of mandrel 1 is not pressurized, as air port 15 is vented to the atmosphere and is not coupled to air supply fitting 22. Yoke 11 is not touching end plate 13, which is free to rotate in order to rotate sleeves with drive unit 9. This is also shown in FIG. 2. Referring now to FIG. 4, in order to change sleeves two steps are required: the weight of mandrel 1 and sleeve 3 is counterbalanced by pneumatic cylinder 10, and retractable pin 26 is retracted in order to free the tailstock end of mandrel 1. First the rotation of mandrel 1 is stopped in a position aligning yoke 11 and pull-studs 14. Secondly, cylinder 10 is activated pulling in yoke 11. This urges the to swing tailstock end of mandrel 1 upwardly. At this point pin 26 is retracted by action of cylinder 24, causing mandrel 1 to swing up as shown in FIG. 4. In order to prevent mandrel 1 from swinging violently upwards cylinder 10 is equipped with flow control devices which limits its speed of actuation. Mandrel 1 pivots around ball 17 until end plate 13 is stopped by air supply fitting 22. At this point a valve (not shown) is opened allowing air to flow from fitting 22 into mandrel 1 via-passage 15. This air pressure allows imaged sleeve 3 to slide off mandrel 1 with ease and a new blank sleeve can be slid on. No details of the imaging process are given as it is not different from prior art laser imaging as used by Computer-to-Plate machines. After a blank sleeve is installed on mandrel 1, the air pressure holding cylinder 10 is released. This causes mandrel 1 to swing down. When mandrel 1 is lined up with the tailstock, pin 26 is inserted into bearing 23 by action of cylinder 24. A stop 27 prevents mandrel 1 from overtravelling.

After mandrel 1 is in its running position, yoke 11 moves further towards the tailstock in order to allow end plate 13 to rotate freely. As the operation of all cylinders and valves can be automatically sequenced, no operator intervention is required except for sliding the sleeves on and off. Even this step can be automated, if desired.

Different lengths of sleeves can be used on the same mandrel. When different inside diameters of sleeves are used, a buffer sleeve, or "build-up sleeve" can be used. When this method is not suitable the complete mandrel 1 can be easily replaced with a mandrel of a different diameter by simply lifting the mandrel up. As seen from FIG. 3, the mandrel is driven by drive unit 9 via pin 19, however it is not physically attached to ball 17. Ball 17 is attached to drive unit 9. The mandrel can be lifted (starting from its tailstock end) thus disengaging pin 19 from drive plate 18.

While the preferred embodiment uses a ball 17 to center the mandrel and allow it to swing up, it is clear that any other type of accurate coupling can be used such a precision hinge.

What is claimed is:

1. A method for holding printing sleeves in an imaging device comprising:

a) providing a printing sleeve having an internal diameter;

b) selecting from a plurality of mandrels having different external diameters a mandrel having an external diameter which matches the internal diameter of the printing sleeve;

c) detachably affixing the selected mandrel to an imaging device;

d) supporting the mandrel on the imaging device from one end only in a first position which allows unobstructed mounting of the printing sleeve on the mandrel;

e) mounting the printing sleeve on the mandrel;

f) bringing the mandrel to a second position used during imaging;

g) adding support to a second end of the mandrel;

h) imaging the printing sleeve while rotating the mandrel with mounted printing sleeve;

i) temporarily removing support from the second end of the mandrel; and, j) returning the mandrel to the first position in order to remove the imaged printing sleeve.

2. A method as claimed in claim 1 wherein air pressure is used to facilitate mounting and removal of sleeves from the mandrel.

3. A method as claimed in claim 1 wherein the printing sleeve is a flexographic sleeve.

4. A method as claimed in claim 1 wherein the printing sleeve is a seamless flexographic sleeve.

5. A method as claimed in claim 1 wherein the printing sleeve is a lithographic printing sleeve.

6. The method of claim 1 wherein adding support to the second end of the mandrel comprises inserting a retractable pin into the second end of the mandrel.

7. The method of claim 6 comprising wherein the mandrel is supported by mandrel-support bearings, the method comprising pre-loading the mandrel-support bearings by applying a force to the retractable pin.

8. The method of claim 7 wherein applying the force to the retractable pin comprises pushing axially on the retractable pin with a pneumatic actuator.

9. The method of claim 1 wherein the mandrel comprises one or more outwardly projecting pull-studs and returning the mandrel to the first position comprises pulling on the pull-studs.

10. The method of claim 9 wherein pulling on the pull studs causes the second end of the mandrel to move upwardly.

11. The method of claim 1 wherein returning the mandrel to the first position connects an interior passage in the mandrel to a source of compressed gas.

12. The method of claim 11 comprising, after returning the mandrel to the first position and while removing the imaged printing sleeve, causing compressed gas to flow from the source of compressed gas through the interior passage in the mandrel and into a region between the mandrel and an inner surface of the sleeve.

13. The method of claim 1 wherein detachably affixing the selected mandrel to the imaging device comprises engaging the first end of the mandrel with a ball attached to a drive mechanism.

14. The method of claim 1 wherein rotating the mandrel comprises rotating a drive plate which receives a drive pin on the mandrel.

15. The method of claim 14 wherein the drive plate is axially flexible so as to substantially eliminate backlash between a drive mechanism and the mandrel.

16. A method for holding printing sleeves in an imaging device comprising:

a) providing a printing sleeve having an internal diameter;

b) selecting from a plurality of build up sleeves having different external diameters a build up sleeve having an external diameter which matches the internal diameter of the printing sleeve;

c) supporting a mandrel on the imaging device from one end only in a first position which allows unobstructed mounting of the build up sleeve and the printing sleeve on the mandrel;

d) mounting the build up sleeve on the mandrel;

e) mounting the printing sleeve on the build up sleeve;

f) bringing the mandrel to a second position used during imaging;

g) adding support to a second end of the mandrel;

h) imaging the printing sleeve while rotating the mandrel with mounted build up sleeve and printing sleeve;

i) temporarily removing support from the second end of the mandrel; and, j) returning the mandrel to the first position in order to remove the imaged printing sleeve.

* * * * *